US010997915B2

(12) United States Patent
Ohara

(10) Patent No.: US 10,997,915 B2
(45) Date of Patent: May 4, 2021

(54) PIXEL CIRCUIT, METHOD FOR DRIVING, AND DISPLAY DEVICE

(71) Applicant: JOLED INC., Tokyo (JP)

(72) Inventor: Masanori Ohara, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 16/717,277

(22) Filed: Dec. 17, 2019

(65) Prior Publication Data

US 2020/0234640 A1 Jul. 23, 2020

(30) Foreign Application Priority Data

Jan. 22, 2019 (JP) ..... JP2019-008448
Jul. 25, 2019 (JP) ..... JP2019-136635

(51) Int. Cl.
*G09G 3/3233* (2016.01)
*G09G 3/3283* (2016.01)
*G09G 3/20* (2006.01)

(52) U.S. Cl.
CPC ..... *G09G 3/3233* (2013.01); *G09G 3/2074* (2013.01); *G09G 3/3283* (2013.01); *G09G 2300/0842* (2013.01); *G09G 2310/08* (2013.01); *G09G 2320/0242* (2013.01)

(58) Field of Classification Search
CPC ... G09G 2300/0426; G09G 2300/0842; G09G 2300/0819; G09G 2300/0809; G09G 2300/0439; G09G 2320/0233; G09G 2320/0223; G09G 2320/0209; G09G 2310/0297; G09G 2310/0235; G09G 3/3648; G09G 3/3233; G09G 3/3607; G09G 3/3258; G09G 3/3225; G09G 3/2003; G09G 3/3685
See application file for complete search history.

(56) References Cited

U.S. PATENT DOCUMENTS 9,607,548 B2 * 3/2017 Kimura ..... G09G 3/20
2005/0116656 A1 * 6/2005 Shin ..... G09G 3/3233 315/169.3
2005/0200617 A1 * 9/2005 Kwak ..... H05B 45/46 345/204
2005/0242743 A1 * 11/2005 Kwak ..... G09G 3/3233 315/160
2005/0243035 A1 * 11/2005 Kwak ..... G09G 3/3233 345/76
2005/0243038 A1 * 11/2005 Kwak ..... G09G 3/3233 345/76
2005/0243039 A1 * 11/2005 Kwak ..... H01L 27/3262 345/76

(Continued)

*Primary Examiner* — Dong Hui Liang
(74) *Attorney, Agent, or Firm* — Greenblum & Bernstein, P.L.C.

(57) ABSTRACT

A pixel circuit includes: one data signal line; one holding capacitor which holds a data signal transmitted through the one data signal line; one drive transistor which outputs a current in accordance with the data signal held at the one holding capacitor; three color selection lines; three color selection transistors having control terminals respectively connected to the three color selection lines that are mutually different; and three light emitting elements being connected to an output end of the current of the one drive transistor via the three color selection transistors, respectively, that are mutually different, and emitting luminescent colors that are mutually different.

9 Claims, 12 Drawing Sheets

(56) References Cited

U.S. PATENT DOCUMENTS

| | | | | |
|---|---|---|---|---|
| 2006/0267885 | A1* | 11/2006 | Kwak | H01L 27/3244 345/76 |
| 2007/0124633 | A1* | 5/2007 | Kim | G09G 3/3233 714/726 |
| 2015/0317952 | A1* | 11/2015 | Ohara | G09G 3/3233 345/213 |
| 2016/0012774 | A1* | 1/2016 | Ohara | G09G 3/3233 345/694 |
| 2016/0210892 | A1* | 7/2016 | Ohara | G09G 3/3266 |
| 2016/0372043 | A1* | 12/2016 | Yamanaka | G09G 3/3266 |
| 2017/0200415 | A1* | 7/2017 | Noguchi | G09G 3/3413 |
| 2017/0255049 | A1* | 9/2017 | Nishiyama | G02F 1/13454 |
| 2017/0301286 | A1* | 10/2017 | Xiang | G09G 3/3233 |
| 2018/0012547 | A1* | 1/2018 | Li | H01L 27/323 |
| 2019/0012948 | A1* | 1/2019 | Ohara | G09G 3/3233 |
| 2019/0114970 | A1* | 4/2019 | Moradi | G09G 3/3266 |

* cited by examiner

Prior Art

Prior Art

Prior Art

PIXEL CIRCUIT, METHOD FOR DRIVING, AND DISPLAY DEVICE

CROSS REFERENCE TO RELATED APPLICATIONS

The present application is based on and claims priority of Japanese Patent Application No. 2019-008448 filed on Jan. 22, 2019, and Japanese Patent Application No. 2019-136635 filed on Jul. 25, 2019. The entire disclosures of the above-identified applications, including the specification, drawings and claims are incorporated herein by reference in their entirety.

FIELD

The present disclosure relates to a pixel circuit, a driving method, and a display device.

BACKGROUND

Color display devices of an active matrix type (hereinafter referred to as color display devices) using an organic electroluminescence (EL) element have been conventionally put into practical use. The color display device is formed by arranging, in a matrix, a plurality of pixel circuits each formed of three sub-pixel circuits loaded with organic EL elements of respective luminescent colors red (R), green (G), and a blue (B). The color display device controls the light emission luminance for each of the sub-pixel circuits to thereby display a color image.

SUMMARY

Technical Problem

In a conventional display device, for example, total luminance $L_{RGB}$ of luminance $L_R$, $L_G$, and $L_B$ provided upon individual-color lighting of respective light emitting elements for R, G, and B may differ from total luminance $L_W$ provided upon simultaneous lighting of the light emitting elements for R, G, and B. In this case, even when a desired gamma characteristic is set for the individual colors R, G, and B, white balance is shifted when white (W) is lit up upon the simultaneous lighting of the light emitting elements for R, G, and B, deteriorating the display quality. Fluctuation of the luminance of the given luminescent color under the influence of the luminance of the different luminescent color which lights up simultaneously as described above is called color crosstalk in this description.

It is an object of the present disclosure to provide a pixel circuit, a display device, and a method for driving a pixel circuit capable of reducing color crosstalk.

Solution to Problem

To address the object described above, a pixel circuit according to one aspect of the disclosure includes: one data signal line; one holding capacitor which holds a data signal transmitted through the one data signal line; one drive transistor which outputs a current in accordance with the data signal held at the one holding capacitor; three color selection lines; three color selection transistors having control terminals respectively connected to the three color selection lines that are mutually different; and three light emitting elements being connected to an output end of the current of the one drive transistor via the three color selection transistors, respectively, that are mutually different and emitting luminescent colors that are mutually different.

A method for driving a pixel circuit according to another aspect of the present disclosure includes one data signal line, one holding capacitor, one drive transistor, three color selection transistors, and three light emitting elements, and the method includes, in each of three subframe periods forming one frame period and corresponding to luminescent colors that are mutually different, holding a data signal, which is related to light emission luminance of a luminescent color corresponding to the subframe period, at the one holding capacitor via the one data signal line; outputting, from the one drive transistor, a current in accordance with the data signal held at the one holding capacitor; and supplying, via any one of the three color selection transistors, the current outputted from the one drive transistor to the light emitting element that is included in the three light emitting elements and that emits the luminescent color corresponding to the subframe period.

Advantageous Effects

With the pixel circuit and the method for driving a pixel circuit according to the present disclosure, the plurality of light emitting elements included in the pixel circuit and emitting the luminescent colors that are mutually different can be caused to emit light sequentially in a time-sharing manner to thereby display a desired color through afterimage effect, which can therefore reduce color crosstalk.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DESCRIPTION OF EMBODIMENT

Knowledge Underlying the Present Disclosure

The inventor has found that color crosstalk occurs in a conventional color display device due to the following factors. Before describing the embodiment of the present disclosure, the factors causing the color crosstalk in the color display device will be described, referring to an example of a typical organic EL display device.

Figure 1:
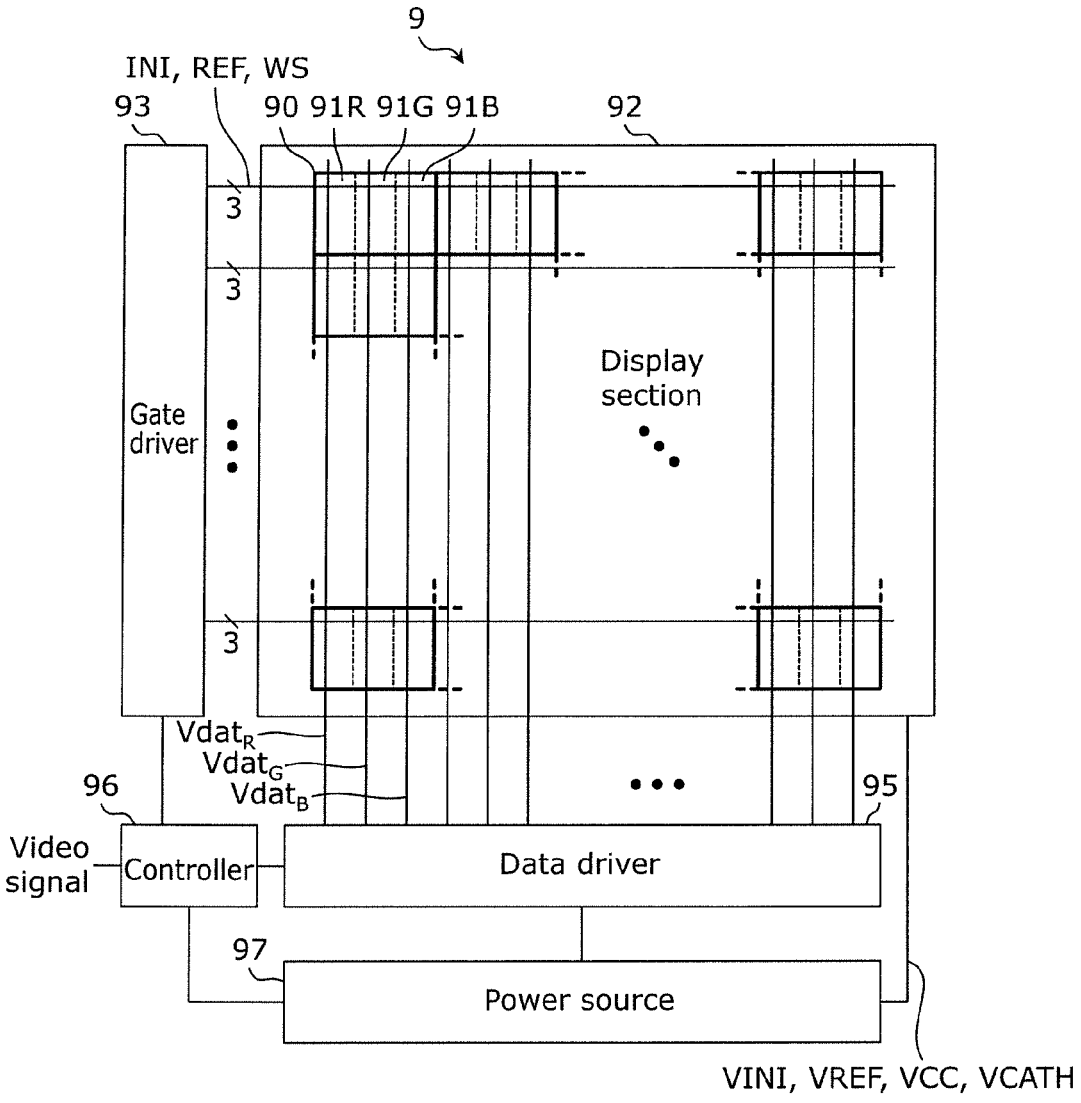
FIG. 1 is a block diagram illustrating one example of a functional configuration of a typical display device.

FIG. 1 is a block diagram illustrating one example of a functional configuration of the typical organic EL display device (hereinafter referred to as a display device). For the purpose of a brief description below, a signal and a wire for transmitting the signal may be referenced with a same sign. Moreover, a circuit and a region where the circuit is formed may be referenced with a same sign.

As illustrated in FIG. 1, a display device 9 includes a display section 92, a gate driver 93, a data driver 95, a controller 96, and a power source 97.

The display section 92 has a plurality of pixel circuits 90 arranged in a matrix. Each pixel circuit 90 is composed of sub-pixel circuits 91R, 91G, and 91B respectively corresponding to luminescent colors R, G, and B.

Three control signal lines INI, REF, and WS are provided which are connected to the plurality of pixel circuits 90 arranged in the same row of the matrix. The control signal lines INI, REF, and WS transmit, to the pixel circuits 90, control signals INI, REF, and WS supplied from the gate driver 93. Note that a number of control signal lines and a number of control signals are each just one example and thus are not limited to this example.

Three data signal lines $Vdat_R$, $Vdat_G$, and $Vdat_B$ are provided which are connected to the plurality of pixel circuits 90 arranged in the same column of the matrix. The data signal lines $Vdat_R$, $Vdat_G$, and $Vdat_B$ respectively transmit, to the pixel circuits 90, data signals $Vdat_R$, $Vdat_G$, and $Vdat_B$ related to the light emission luminance of R, G, and B supplied from the data driver 95.

The controller 96 receives a video signal from an outside and supplies, to the gate driver 93 and the data driver 95, a control signal for displaying an image of each frame of the video signal at the display section 92.

The power source 97 supplies reference voltages and supply voltages to the display section 92, the gate driver 93, the data driver 95, and the controller 96. The power source 97 supplies, for example, reference voltages VINI and VREF, a positive supply voltage VCC and a negative supply voltage VCATH to the display section 92.

Figure 2:
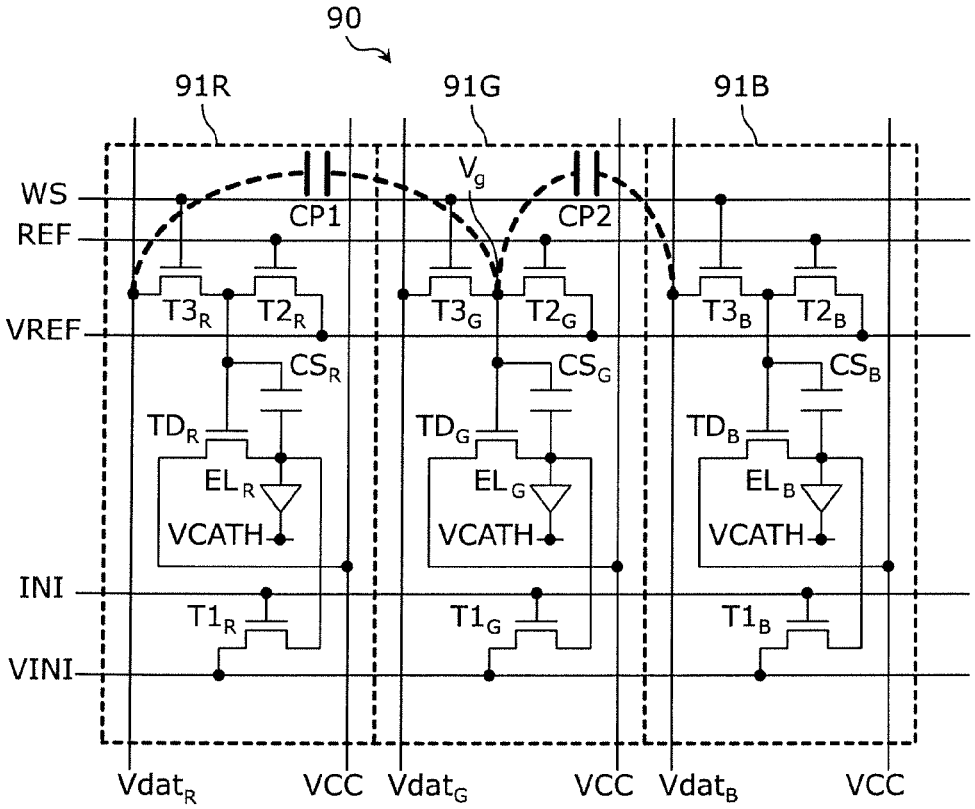
FIG. 2 is a circuit diagram illustrating one example of a configuration of a typical pixel circuit.

FIG. 2 is a circuit diagram illustrating one example of a configuration of the pixel circuit 90. As illustrated in FIG. 2, the sub-pixel circuits 91R, 91G, and 91B forming the pixel circuit 90 have the same configuration. Hereinafter, the configuration of the pixel circuit 90 will be described, focusing on the sub-pixel circuit 91R.

The sub-pixel circuit 91R has an initialization transistor $T1_R$, a compensation transistor $T2_R$, a write transistor $T3_R$, a holding capacitor $CS_R$, a drive transistor $TD_R$, and a light emitting element $EL_R$. Each of the transistors is formed by an N-type channel transistor as one example.

The sub-pixel circuit 91R also has the control signal lines INI, REF, and WS, reference voltage lines VINI and VREF, the data signal line $Vdat_R$, a positive power line VCC, and a negative power line VCATH.

The initialization transistor $T1_R$ turns into an ON state in accordance with the control signal INI and sets a source node of the drive transistor $TD_R$ at the reference voltage VINI.

The compensation transistor $T2_R$ turns into an ON state in accordance with the control signal REF and sets a gate node of the drive transistor $TD_R$ at the reference voltage VREF.

The write transistor $T3_R$ turns into an ON state in accordance with the control signal WS and holds a voltage of the data signal $Vdat_R$ at the holding capacitor $CS_R$.

The drive transistor $TD_R$ supplies a current to the light emitting element $EL_R$ in accordance with the voltage held at the holding capacitor $CS_R$. Consequently, the light emitting element $EL_R$ emits light with luminance represented by the data signal $Vdat_R$.

The sub-pixel circuits 91G and 91B are formed in the same manner as the sub-pixel circuit 91R.

In the sub-pixel circuits 91R, 91G, and 91B in the pixel circuit 90, the data signals $Vdat_R$, $Vdat_G$, and $Vdat_B$ are held at the same timing in accordance with the same control signals INI, REF, and WS and the light emitting elements $EL_R$, $EL_G$, and $EL_B$ emit light with luminance in accordance with the held data signals.

Figure 3:
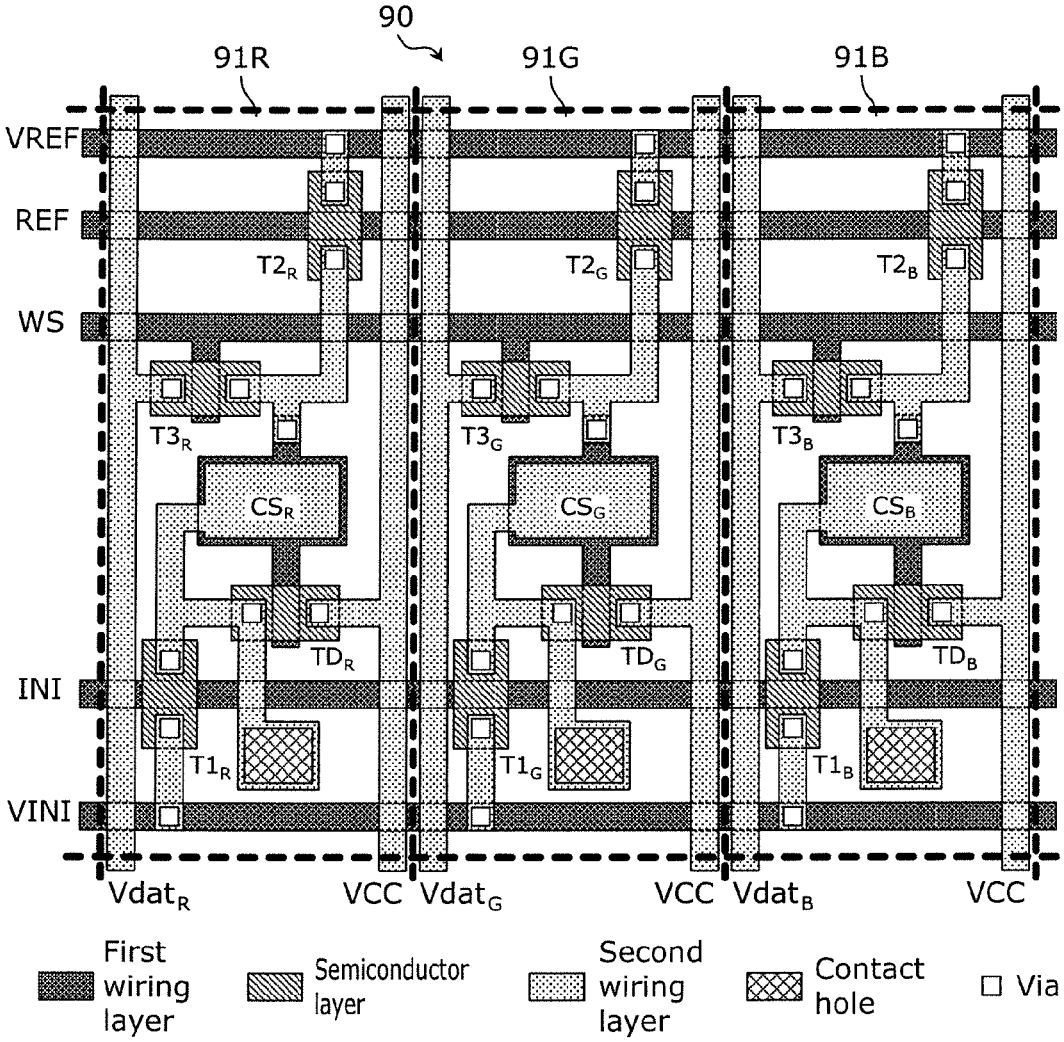
FIG. 3 is a plan view schematically illustrating one example of a structure of the typical pixel circuit.

FIG. 3 is a plan view schematically illustrating one example of a structure of the pixel circuit 90. As illustrated in FIG. 3, the sub-pixel circuits 91R, 91G, and 91B are respectively formed in three sub-pixel regions 91R, 91G, and 91B obtained by dividing the pixel region 90.

The pixel circuit 90 is formed by, for example, a first wiring layer, a semiconductor layer, and a second wiring layer arranged on a substrate in order just mentioned. The first wiring layer is mainly used as a first electrode of the control signal lines INI, REF, and WS, the reference voltage lines VINI and VREF, and the holding capacitors $CS_R$, $CS_G$, and $CS_B$ and a gate electrode of each transistor. The semiconductor layer is used as a channel region of each transistor. The second wiring layer is mainly used as a second electrode of the data signal lines $Vdat_R$, $Vdat_G$, and $Vdat_B$, the positive power line VCC, and the holding capacitors $CS_R$, $CS_G$, and $CS_B$ and a source electrode and a drain electrode of each transistor. The different layers are connected together with a via.

Note that a planarizing layer, not illustrated, is provided to cover the substrate, the first wiring layer, the semiconductor layer, and the second wiring layer, and the light emitting elements $EL_R$, $EL_G$, and $EL_B$ are formed on the planarizing layer. The light emitting elements $EL_R$, $EL_G$, and $EL_B$ are respectively connected to source nodes of the drive transistors $TD_R$, $TD_G$, and $TD_B$ via a contact hole opening in the planarizing layer.

Color crosstalk occurring in the pixel circuit 90 configured as described above will be described.

The light emitting elements $EL_R$, $EL_G$, and $EL_B$ included in the pixel circuit 90 emit light with the luminance in accordance with the data signals $Vdat_R$, $Vdat_G$, and $Vdat_B$ held at the holding capacitors $CS_R$, $CS_G$, and $CS_B$ at the same timing in accordance with the same control signals INI, REF, and WS.

As illustrated in FIG. 2, parasitic capacitors CP1 and CP2 are located between a gate node of the drive transistor $TD_G$ and the data signal lines $Vdat_R$ and $Vdat_B$ of the sub-pixel circuits 91R and 91B. Thus, a voltage $V_g$ of the gate node of the drive transistor $TD_G$, that is, the data signal $Vdat_G$ held at the holding capacitor $CS_G$ is influenced by the fluctuation of the data signals $Vdat_R$ and $Vdat_B$ via the parasitic capacitors CP1 and CP2.

As illustrated in FIG. 3, the data signal lines $Vdat_R$, $Vdat_G$, and $Vdat_B$ are provided in the corresponding sub-pixel circuits 91R, 91G, and 91B adjacently to each other. Thus, the parasitic capacitors CP1 and CP2 are likely to increase and the voltage $V_9$ of the gate node of the drive transistor $TD_G$ is likely to be influenced by the fluctuation of the data signals $Vdat_R$ and $Vdat_B$.

The fluctuation of the voltage $V_g$ of the gate node of the drive transistor $TD_G$ under the influence of the data signals $Vdat_R$ and $Vdat_B$ results in the fluctuation of the light emission luminance of the light emitting element $EL_G$. A fluctuation amount $\Delta V_g$ attributable to capacitive coupling of the voltage $V_g$ of the gate node of the drive transistor $TD_G$ is expressed by Expression (1) as one example where a total of the capacitors (including the parasitic capacitors) connected to the gate node is $C_{tot}$.

[Math 1]

$$\Delta V_g \cong \Delta Vdat_R \times CP1/C_{tot} + \Delta Vdat_B \times CP2/C_{tot} \quad (1)$$

Similarly, a voltage of the gate node of the drive transistor $TD_R$ of the sub-pixel circuit 91R fluctuates under the influence of the data signal $Vdat_G$ and the data signal $Vdat_B$ of the different sub-pixel circuit (not illustrated) adjacent to the sub-pixel circuit 91R, whereby the light emission luminance of the light emitting element $EL_R$ fluctuates.

Similarly, a voltage of a gate node of the drive transistor $TD_B$ of the sub-pixel circuit 91B fluctuates under the influence of the data signal $Vdat_G$ and the data signal $Vdat_R$ of the different sub-pixel circuit (not illustrated) adjacent to the sub-pixel circuit 91B, whereby the light emission luminance of the light emitting element $EL_B$ fluctuates.

The color crosstalk occurs as described above.

EMBODIMENT

Hereinafter, the embodiment of the present disclosure will be described in detail with reference to the drawings. Note that each of the embodiments described below illustrates one comprehensive or detailed example of the present disclosure. Therefore, numerical values, shapes, materials, components, arrangement and connection modes of the components, etc. indicated in the embodiment below each form one example and are not intended to limit the present disclosure in any manner.

A display device according to the embodiment causes a plurality of light emitting elements included in a pixel circuit and emitting luminescent colors that are mutually different to emit light sequentially in a time-sharing manner to display a desired color through afterimage effect, thereby reducing the color crosstalk.

Figure 4:
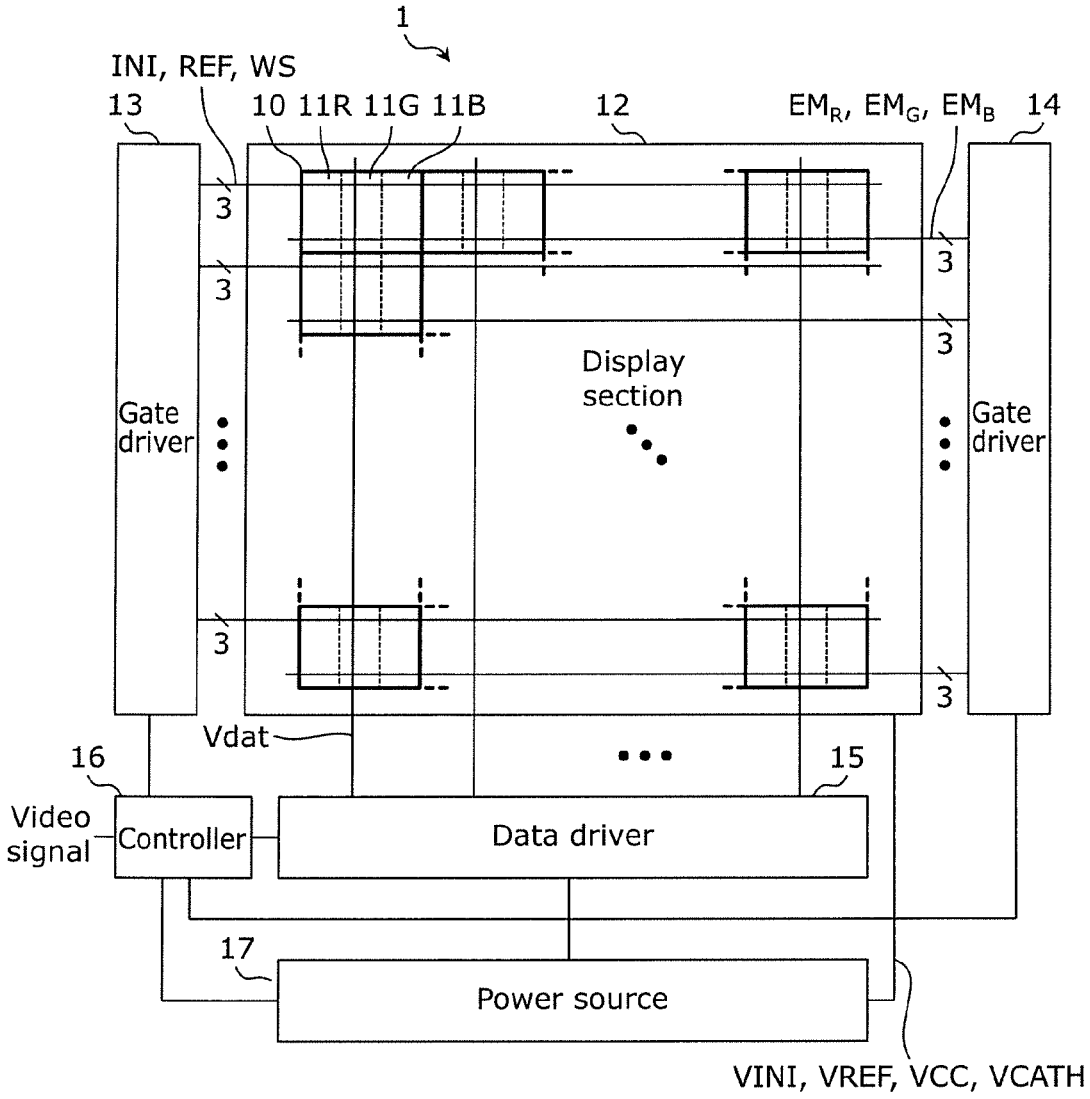
FIG. 4 is a block diagram illustrating one example of a functional configuration of a display device according to an embodiment.

FIG. 4 is a block diagram illustrating one example of a functional configuration of the display device according to the embodiment. For the purpose of a brief description below, a signal and a wiring for transmitting the signal may be referenced with a same sign. Moreover, a circuit and a region where the circuit is formed may be referenced with a same sign.

As illustrated in FIG. 4, the display device 1 includes a display section 12, gate drivers 13 and 14, a data driver 15, a controller 16, and a power source 17.

The display section 12 is formed by arranging a plurality of pixel circuits 10 in a matrix. Each of the pixel circuits 10 is formed in a pixel region 10 divided into sub-pixel regions 11R, 11G, and 11B respectively corresponding to luminescent colors R, G, and B.

Three control signal lines are provided in each row of the matrix in connection with the plurality of pixel circuits 10 arranged in the same row. The control signal lines transmit, to the pixel circuits 10, control signals INI, REF, and WS supplied from the gate driver 13. Note that a number of control signal lines and a number of control signals are each just one example and not limited to this example.

Moreover, three color selection lines are provided in each row of the matrix in connection with the plurality of pixel circuits 10 arranged in the same row. The color selection lines transmit, to the pixel circuits 10, control to signals $EM_R$, $EM_G$, and $EM_B$ supplied from the gate driver 14.

One data signal line is provided in each column of the matrix in connection with the plurality of pixel circuits 10 arranged in the same column. The data signal line transmits, to the pixel circuits 10, a data signal Vdat related to the light emission luminance of the R, G, and B supplied from the data driver 15. The data signal Vdat includes data signals related to the light emission luminances of the respective luminescent colors R, G, and B in a time-sharing manner.

The controller 16 receives a video signal from an outside and supplies, to the gate drivers 13 and 14 and the data driver 15, a control signal for displaying an image of each frame of the video signal at the display section 12.

The power source 17 supplies reference voltages and supply voltages to the display section 12, the gate drivers 13 and 14, the data driver 15, and the controller 16. The power source 17 supplies, for example, reference voltages VINI and VREF, a positive supply voltage VCC, and a negative supply voltage VCATH to the display section 12.

Figure 5:
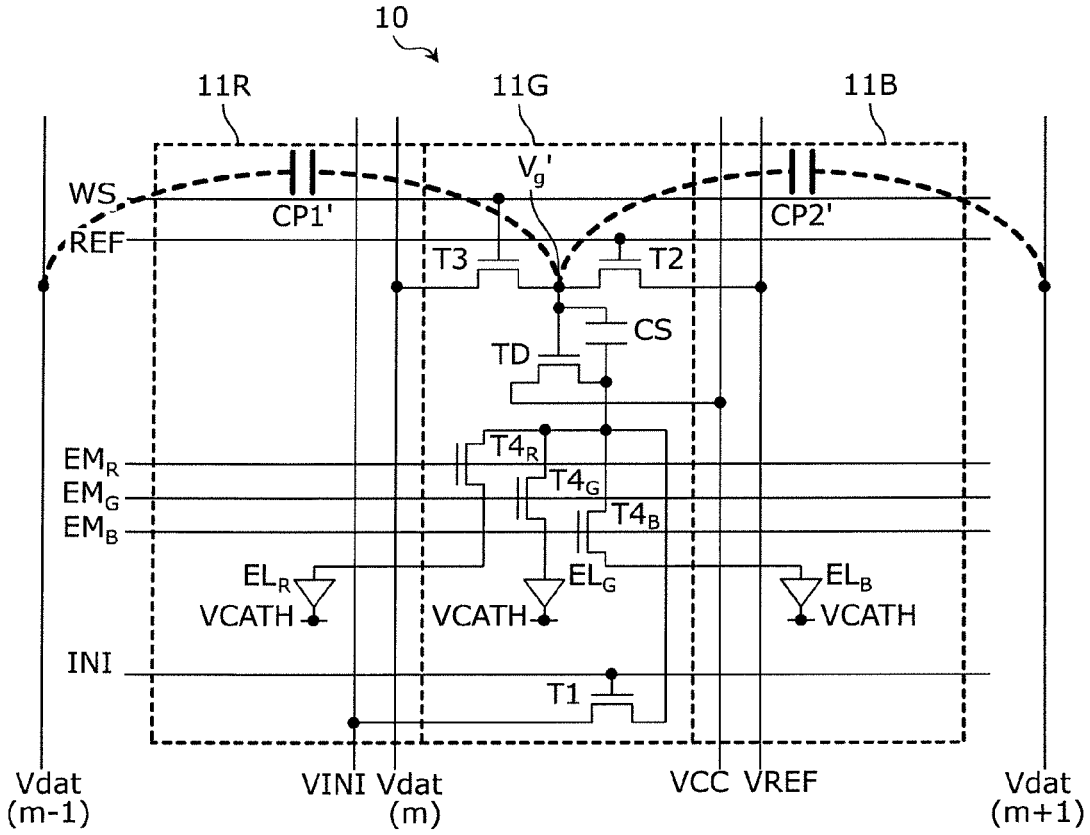
FIG. 5 is a circuit diagram illustrating one example of a configuration of a pixel circuit according to the embodiment.

FIG. 5 is a circuit diagram illustrating one example of a configuration of the pixel circuit 10. As illustrated in FIG. 5, the pixel circuit 10 has an initialization transistor T1, a compensation transistor T2, a write transistor T3, a holding capacitor CS, a drive transistor TD, color selection transistors $T4_R$, $T4_G$, and $T4_B$, and light emitting elements $EL_R$, $EL_G$, and $EL_B$. Each of the transistors is formed by an N-type channel transistor as one example.

The pixel circuit 10 also has control signal lines INI, REF, and WS, reference voltage lines VINI and VREF, color selection lines $EM_R$, $EM_G$, and $EM_B$, a data signal line Vdat, a positive power line VCC, and a negative power line VCATH.

Note that FIG. 5 illustrates, together with a data signal line Vdat (m) of the pixel circuit 10, data signal lines Vdat (m−1) and Vdat (m+1) of the different pixel circuits adjacent to both sides of the pixel circuit 10.

The initialization transistor T1 turns into an ON state in accordance with the control signal INI and sets a source node of the drive transistor TD at the reference voltage VINI.

The compensation transistor T2 turns into an ON state in accordance with the control signal REF and sets a gate node of the drive transistor TD at the reference voltage VREF.

The write transistor T3 turns into an ON state in accordance with the control signal WS and holds a voltage of the data signal Vdat at the holding capacitor CS.

The drive transistor TD outputs a current at a level corresponding to the voltage held at the holding capacitor CS.

The color selection transistors $T4_R$, $T4_G$, and $T4_6$ selectively turn into an ON state in accordance with the control signals $EM_R$, $EM_G$, and $EM_B$ and supply a current outputted from the drive transistor TD to the light emitting element $EL_R$, $EL_G$, or $EL_B$. Consequently, the light emitting elements $EL_R$, $EL_G$, and $EL_B$ emit light with luminance represented by the data signal Vdat.

Figure 6:
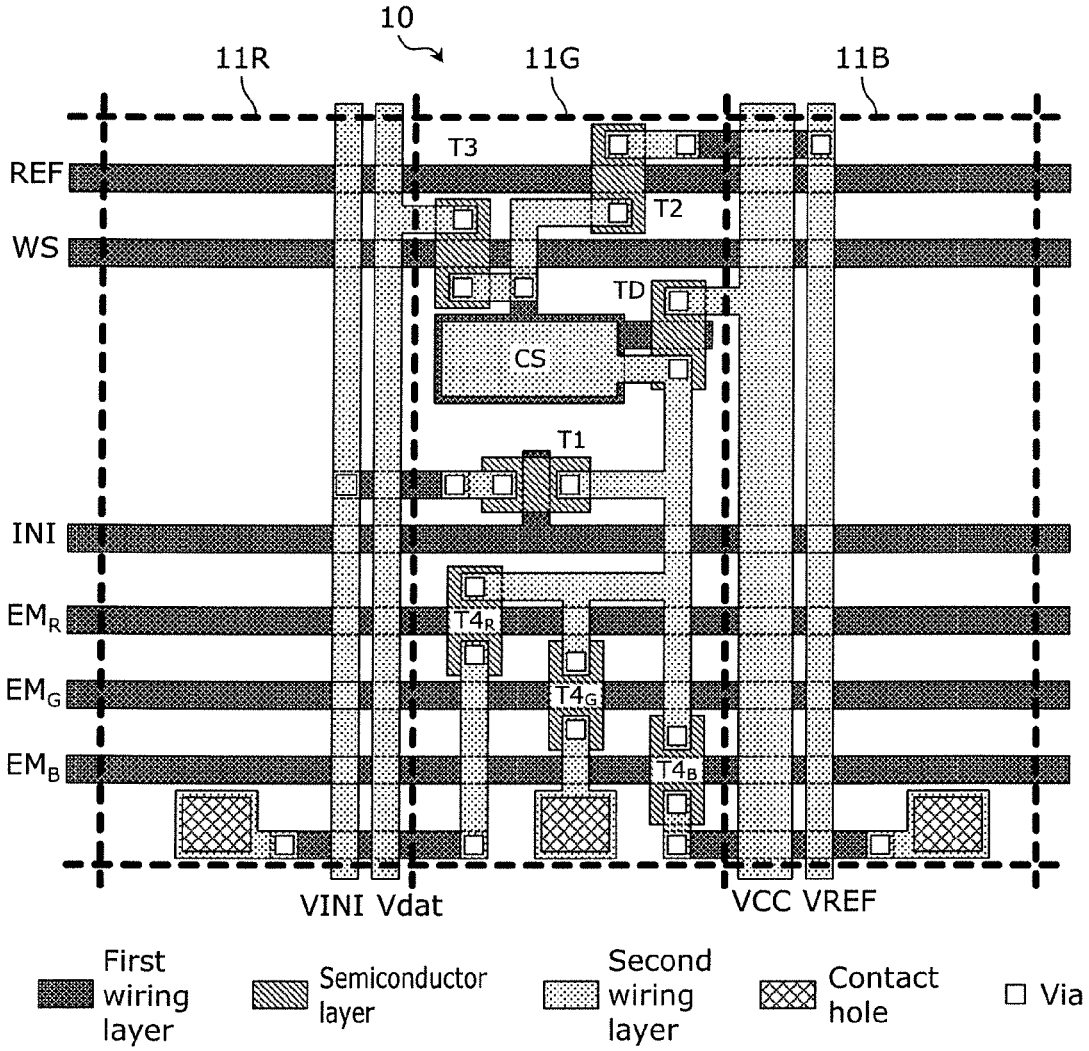
FIG. 6 is a plan view schematically illustrating one example of a structure of the pixel circuit according to the embodiment.

FIG. 6 is a plan view schematically illustrating one example of a structure of the pixel circuit 10. As illustrated in FIG. 6, the pixel circuit 10 is formed in the pixel region 10 divided into the three sub-pixel regions 11R, 11G, and 11B.

The pixel circuit 10 is formed by, for example, a first wiring layer, a semiconductor layer, and a second wiring layer arranged on a substrate in order just mentioned. The first wiring layer is mainly used as a first electrode of the control signal lines INI, REF, WS, $EM_R$, $EM_G$, and $EM_B$, and the holding capacitor CS and also as a gate electrode of each transistor. The semiconductor layer is used as a channel region of each transistor. The second wiring layer is mainly used as a second electrode of the data signal line Vdat, the reference voltage lines VINI and VREF, the positive power line VCC, and the holding capacitor CS and also as a source electrode and a drain electrode of each transistor. The different layers are connected together with a via.

The light emitting elements $EL_R$, $EL_G$, and $EL_B$ are respectively arranged in the sub-pixel regions 11R, 11G, and 11B, and the holding capacitor CS, the drive transistor TD, and the color selection transistors $T4_R$, $T4_G$, and $T4_B$ are arranged in the sub-pixel region 11G. The data signal line Vdat is arranged in the sub-pixel region 11R.

A method for driving the pixel circuit 10 and the display device 1 configured as described above will be described.

Figure 7A:
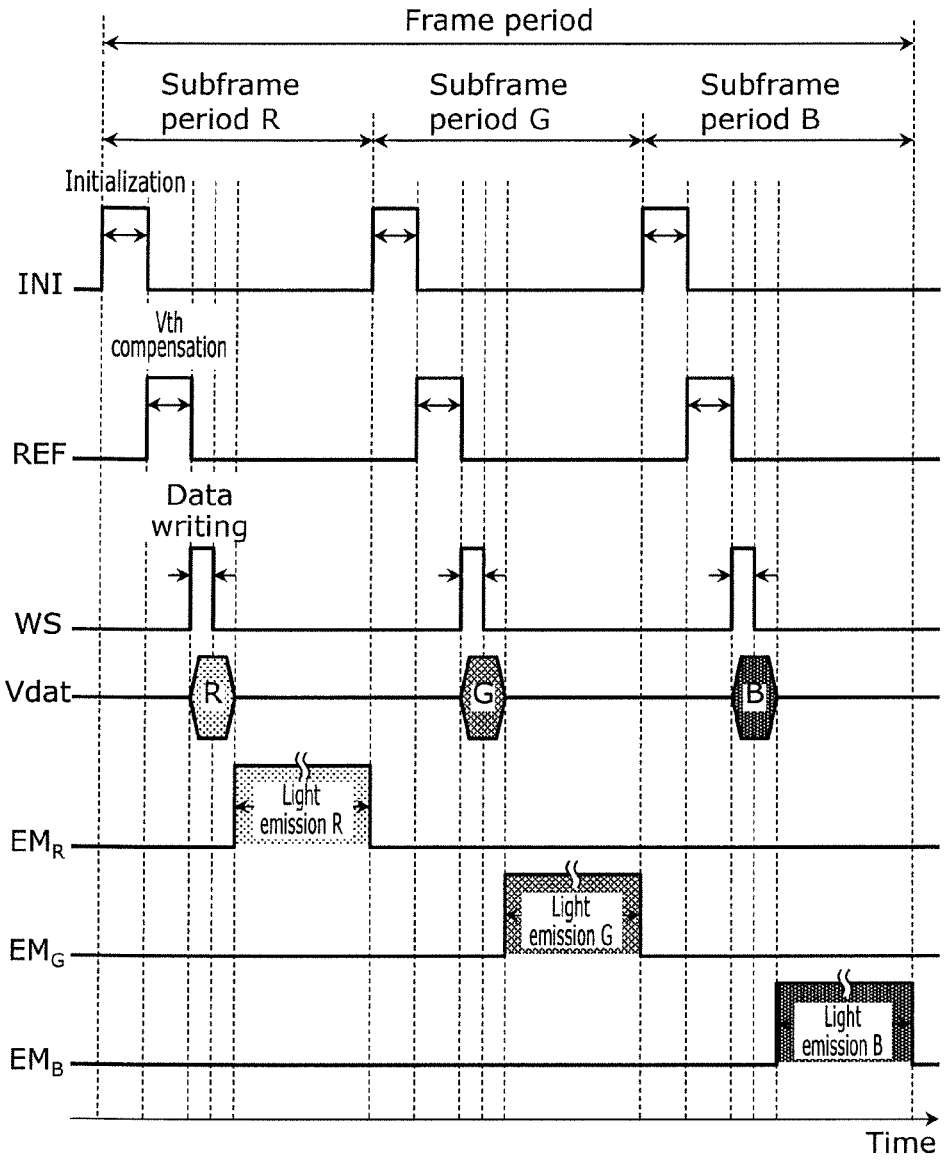
FIG. 7A is a timing chart illustrating one example of a method for driving the pixel circuit according to the embodiment.

FIG. 7A is a timing chart illustrating one example of the method for driving the pixel circuit 10. As illustrated in FIG. 7A, the light emitting elements $EL_R$, $EL_G$, and $EL_B$ arranged in the sub-pixel regions 11R, 11G, and 11B in the pixel circuit 10 are caused to emit light sequentially in a time-sharing manner in subframe periods R, G, and B forming one frame period and corresponding to the luminescent colors R, G, and B to thereby display a desired color through afterimage effect.

Specifically, the following operation is performed in the pixel circuit 10 in each of the subframe periods R, G, and B respectively corresponding to the luminescent colors R, G, and B within one frame period.

The data signal Vdat related to the light emission luminance of the luminescent color R, G, or B corresponding to the subframe period is held at the holding capacitor CS via the data signal line Vdat (initialization, Vth compensation, and data writing). A current in accordance with the data signal Vdat held at the holding capacitor CS is outputted from the drive transistor TD. The current outputted from the drive transistor TD is supplied to the light emitting element $EL_R$, $EL_G$, or $EL_B$ for the luminescent color corresponding to the subframe period via any of the color selection transistors $T4_R$, $T4_G$, and $T4_B$ which are different for the respective subframe periods (light emission R, light emission G, and light emission B).

Figure 7B:
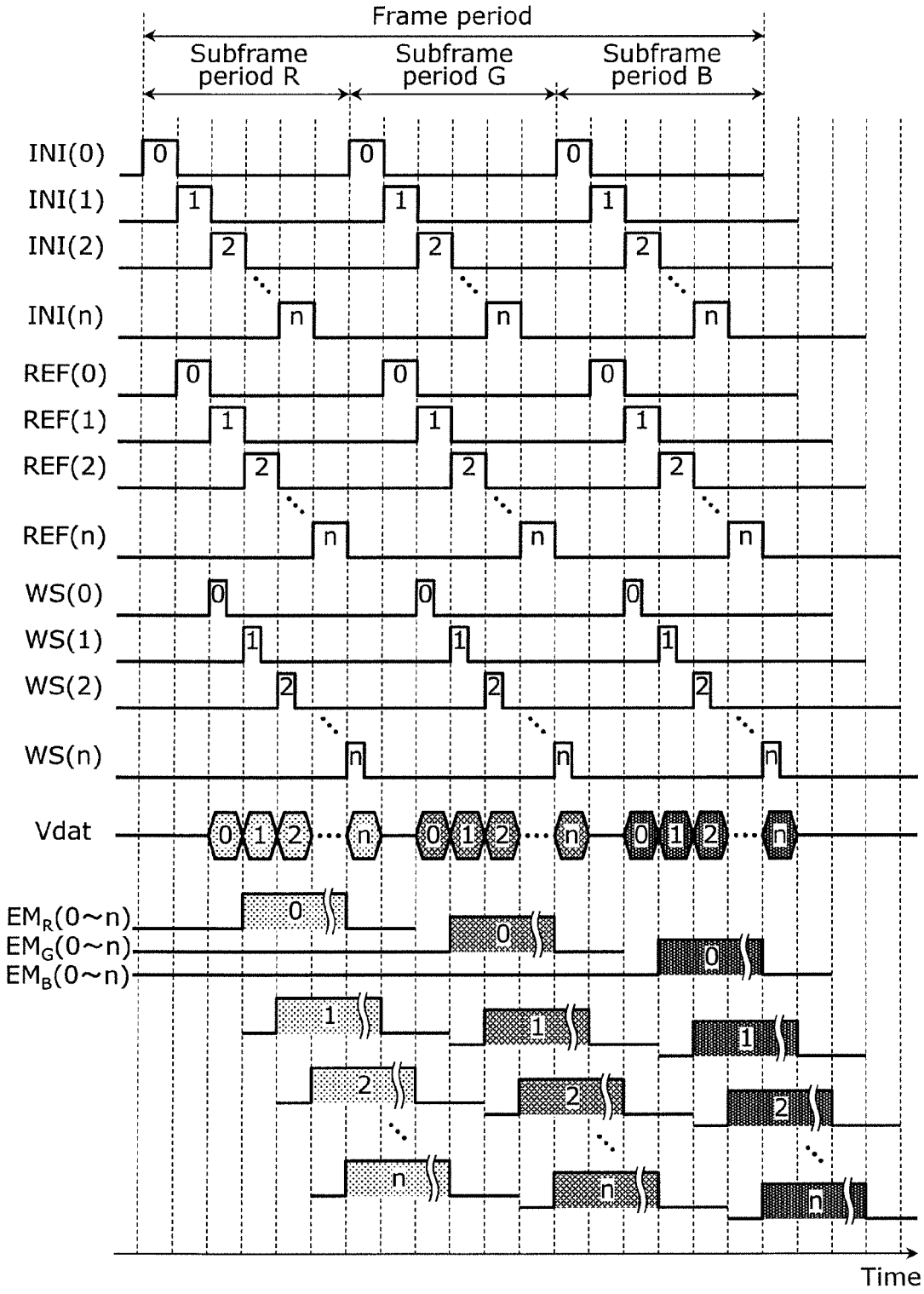
FIG. 7B is a timing chart illustrating one example of a method for driving the display device according to the embodiment.

FIG. 7B is a timing chart illustrating one example of the method for driving the display device 1. Numbers in brackets added to signal names in FIG. 7B indicate rows to which a signal is supplied. As illustrated in FIG. 7B, operation of the pixel circuit 10 illustrated in FIG. 7A is performed row by row in the pixel circuits of the display device 1 in all rows 0 to n.

In FIGS. 7A and 7B, the control signals for N-type channel transistors are illustrated, although the control signals are not limited to this example. For example, the pixel circuit 10 may be formed by use of a P-type channel transistor, and used as a control signal in this case is a control signal for a P-type channel transistor obtained by inversing the polarities of the control signal illustrated in FIGS. 7A and 7B.

The reduction in the color crosstalk occurring in the pixel circuit 10 configured as described above will be described based on comparison with the pixel circuit 90.

In the pixel circuit 10, the light emitting elements $EL_R$, $EL_G$, and $EL_B$ included in the pixel circuit 10 are caused to emit light sequentially in a time-sharing manner with the luminance in accordance with the data signal Vdat to thereby display a desired color.

As illustrated in FIG. 5, parasitic capacitors CP1' and CP2' are located between the gate node of the drive transistor TD and the data signal lines Vdat (m−1) and Vdat (m+1) of the adjacent different pixel circuits. Thus, a voltage $V_g'$ of the gate node of the drive transistor TD in the pixel circuit 10 is influenced by the fluctuation of the data signals Vdat (m−1) and Vdat (m+1) of the pixel circuits 10 in the adjacent columns via the parasitic capacitors CP1' and CP2'.

As illustrated in FIG. 6, one data signal line Vdat is provided for each pixel circuit 10, and thus an interval between the data signal lines Vdat is wider than an interval of the data signal lines $Vdat_R$, $Vdat_G$, and $Vdat_B$ of FIG. 3.

A fluctuation amount $\Delta V_g'$ attributable to capacitive coupling of the voltage $V_g'$ of the gate node of the drive transistor TD is expressed by Expression (2) as one example where a total of the capacitors (including the parasitic capacitors) connected to the gate node is $C_{tot}'$.

[Math 2]

$$\Delta V_g' \cong \Delta \mathrm{Vdat}(m-1) \times CP1'/C_{tot}' + \Delta \mathrm{Vdat}(m+1) \times CP2'/C_{tot}' \quad (2)$$

Capacitance values are inversely proportional to a distance between the electrodes here, thus reaching CP1'<CP1 and CP2'<CP2 through comparison with Expression (1) described above. The parasitic capacitors CP1' and CP2' are respectively smaller than the parasitic capacitors CP1 and CP2, so that the $V_g'$ of the gate node of the drive transistor TD is hardly influenced by the data signals of the adjacent pixel circuits.

Moreover, arranging the holding capacitor CS, the drive transistor TD, and the data signal line Vdat in the different sub-pixel region makes it easy to upsize the holding capacitor CS. The upsizing of the holding capacitor CS increases $C_{tot}'$, thus making it possible to more reduce the fluctuation of the voltage $V_g'$ of the gate node of the drive transistor TD attributable to the capacitive coupling.

Further, the light emissions of the different luminescent colors are performed sequentially in a time-sharing manner in the pixel circuit 10, and thus a data signal related to the luminance of the same luminescent color is transmitted at the same timing in the adjacent data signal line. As a result, color crosstalk such that the luminance of one of the luminescent colors is influenced by the luminance of another one of the luminescent colors is practically resolved.

The effect of reducing the color crosstalk is not limited to the pixel circuit 10 but this effect can also be provided by use of another pixel circuit which includes one data signal line, one holding capacitor, one drive transistor, three color selection lines, three color selection transistors, and three light emitting elements for luminescent colors that are mutually different. A modified example of such a pixel circuit will be described below.

Figure 8:
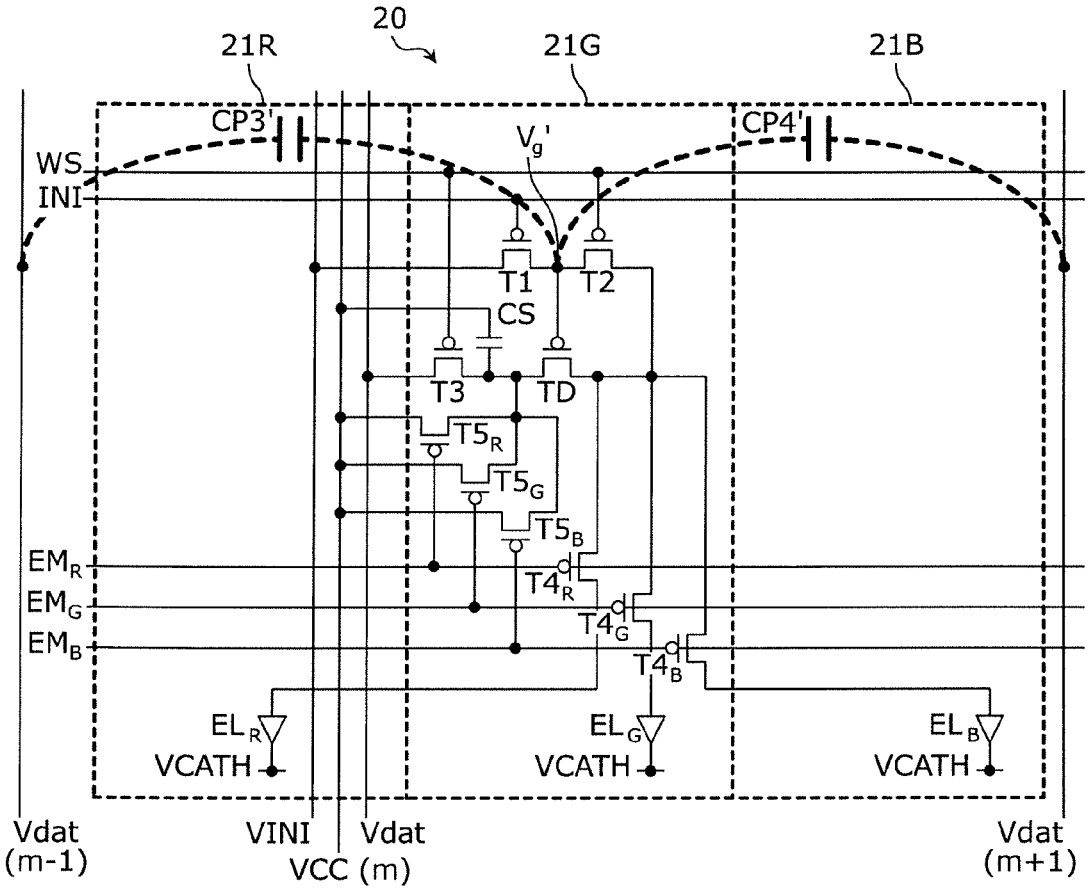
FIG. 8 is a circuit diagram illustrating one example of a configuration of a pixel circuit according to Modified Example 1.

FIG. 8 is a circuit diagram illustrating one example of a configuration of a pixel circuit 20 according to Modified Example 1. As illustrated in FIG. 8, the pixel circuit 20 is formed in a pixel region 20 divided into sub-pixel regions 21R, 21G, and 21B respectively corresponding to luminescent colors R, G, and B.

The pixel circuit 20 has an initialization transistor T1, a compensation transistor T2, a write transistor T3, a holding capacitor CS, a drive transistor TD, color selection transistors $T4_R$, $T4_G$, and $T4_B$, emission control transistors $T5_R$, $T5_G$, and $T5_B$, and light emitting elements $EL_R$, $EL_G$, and $EL_B$. Each of the transistors is formed by a P-type channel transistor as one example.

The pixel circuit 20 also has control signal lines INI and WS, a reference voltage line VINI, color selection lines $EM_R$, $EM_G$, and $EM_B$, a data signal line Vdat, a positive power line VCC, and a negative power line VCATH.

Note that FIG. 8 illustrates, together with a data signal line Vdat (m) of the pixel circuit 20, data signal lines Vdat (m−1) and Vdat (m+1) of different pixel circuits adjacent to both sides of the pixel circuit 20.

The initialization transistor T1 turns into an ON state in accordance with the control signal INI and sets a gate node of the drive transistor TD at a reference voltage VINI.

The compensation transistor T2 turns into an ON state in accordance with the control signal WS and sets the gate node of the drive transistor TD at a threshold value Vth of the drive transistor TD.

The write transistor T3 turns into an ON state in accordance with the control signal WS and holds a voltage of the data signal Vdat at the holding capacitor CS.

The emission control transistors $T5_R$, $T5_G$, and $T5_B$ selectively turn into an ON state in accordance with control signals $EM_R$, $EM_G$, and $EM_B$ and connects a source node of the drive transistor TD to the positive power line VCC.

The drive transistor TD outputs a current at a level corresponding to the voltage held at the holding capacitor CS.

The color selection transistors $T4_R$, $T4_G$, and $T4_B$ selectively turn into an ON state in accordance with the control signals $EM_R$, $EM_G$, and $EM_B$ and supply a current outputted from the drive transistor TD to the light emitting element $EL_R$, $EL_G$, or $EL_B$. Consequently, the light emitting elements $EL_R$, $EL_G$, and $EL_B$ emit light with luminance represented by the data signal Vdat.

A method for driving the pixel circuit 20 configured as described above will be described.

Figure 9:
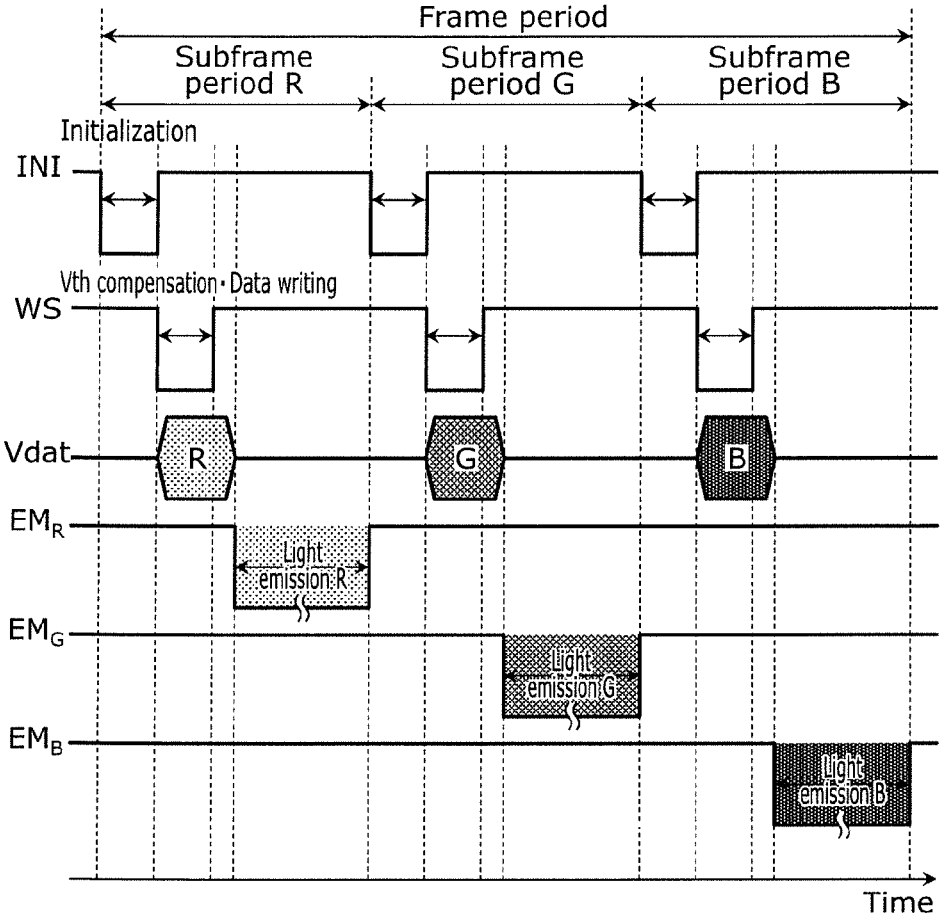
FIG. 9 is a timing chart illustrating one example of a method for driving the pixel circuit according to Modified Example 1.

FIG. 9 is a timing chart illustrating one example of the method for driving the pixel circuit 20. As illustrated in FIG. 9, the light emitting elements $EL_R$, $EL_G$, and $EL_B$ arranged in the sub-pixel regions 21R, 21G, and 21B in the pixel circuit 20 are caused to emit light sequentially in a time-sharing manner in subframe periods R, G, and B forming one frame period and corresponding to the luminescent colors R, G, and B to thereby display a desired color through afterimage effect.

Specifically, the following operation is performed in the pixel circuit 20 in each of the subframe periods R, G, and B respectively corresponding to the luminescent colors R, G, and B in one frame period.

The data signal Vdat related to the light emission luminance of the luminescent color R, G, or B corresponding to the subframe period is held at the holding capacitor CS via the data signal line Vdat (initialization, Vth compensation, and data writing).

A positive supply voltage VCC is supplied from the positive power line VCC to the drive transistor TD via the emission control transistors $T5_R$, $T5_G$, and $T5_B$ which are different for the respective subframe periods. A current in accordance with the data signal Vdat held at the holding capacitor CS is outputted from the drive transistor TD. The current outputted from the drive transistor TD is supplied to the light emitting element $EL_R$, $EL_G$, or $EL_B$ for the luminescent color corresponding to the subframe period via any of the color selection transistors $T4_R$, $T4_G$, and $T4_B$ which are different for the respective subframe periods (light emission R, light emission G, and light emission B).

Note that the control signal WS supplied to the pixel circuit arranged in the adjacent row may be used as the control signal INI. In this case, the control signal INI is omitted.

FIG. 9 illustrates the control signals for P-type channel transistors, although the control signals are not limited to this example. For example, the pixel circuit 20 may be formed by use of N-type channel transistors, and used as the control signal in this case is a control signal for an N-type channel transistor obtained by inverting the polarities of the control signal illustrated in FIG. 9.

Reduction in the color crosstalk occurring in the pixel circuit 20 configured as described above will be described based on comparison with a pixel circuit according to a comparative example.

Figure 10:
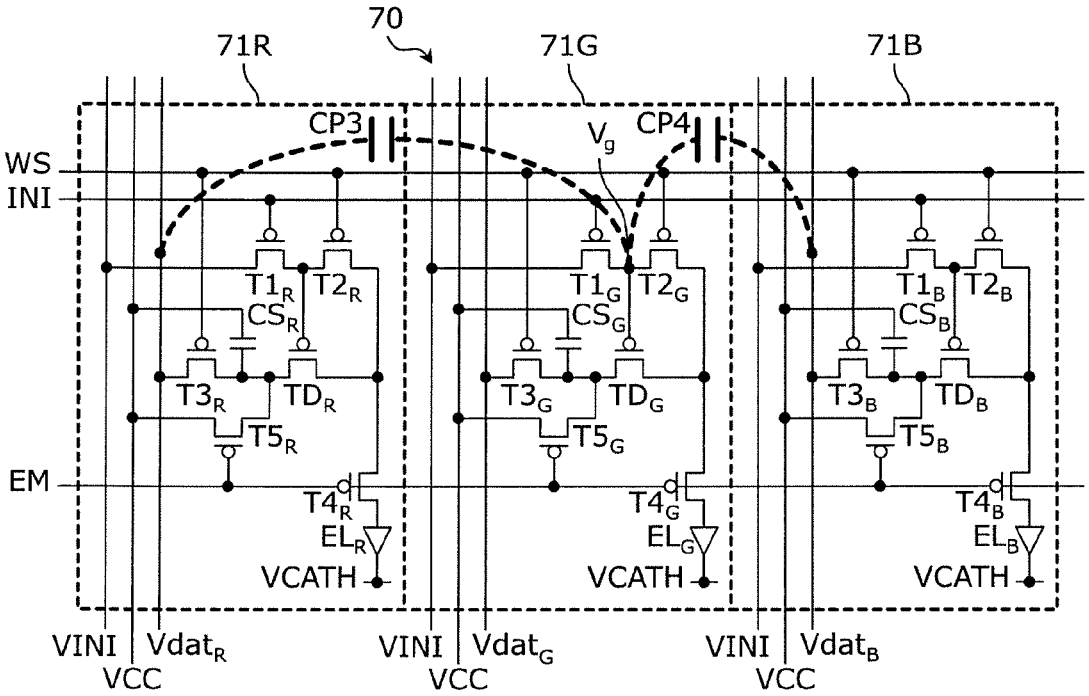
FIG. 10 is a circuit diagram illustrating one example of a configuration of a pixel circuit according to Comparative Example 1.

FIG. 10 is a circuit diagram illustrating one example of a configuration of a pixel circuit 70 according to Comparative Example 1. The pixel circuit 70 differs from the pixel circuit 20 in that data signal lines $Vdat_R$, $Vdat_G$, and $Vdat_B$ for respective luminescent colors, initialization transistors $T1_R$, $T1_G$, and $T1_B$, compensation transistors $T2_R$, $T2_G$, and $T2_B$, write transistors $T3_R$, $T3_G$, and $T3_B$, holding capacitors $CS_R$, $CS_G$, and $CS_B$, and drive transistors $TD_R$, $TD_G$, and $TD_B$ are provided in corresponding sub-pixel circuits 71R, 71G, and 71B. Each of the transistors is formed by a P-type channel transistor as one example.

As illustrated in FIG. 10, a reference voltage line VINI and a positive power line VCC may be provided for each of the sub-pixel circuits 71R, 71G, and 71B or one reference voltage line VINI and one positive power line VCC may be provided for the pixel circuit 70 as a whole.

As illustrated in FIG. 10, parasitic capacitors CP3 and CP4 are located between a gate node of the drive transistor $TD_G$ and the data signal lines $Vdat_R$ and $Vdat_B$ of the sub-pixel circuits 71R and 71B. Thus, a voltage $V_g$ of the gate node of the drive transistor $TD_G$, that is, a data signal $Vdat_G$ held at the holding capacitor $CS_G$ is influenced by the fluctuation of data signals $Vdat_R$ and $Vdat_B$ via the parasitic capacitors CP3 and CP4.

The data signal lines $Vdat_R$, $Vdat_G$, and $Vdat_B$ in the pixel circuit 70 are provided in the corresponding sub-pixel circuits 71R, 71G, and 71B adjacently to each other. Thus, the parasitic capacitors CP3 and CP4 are likely to increase and a voltage of the gate node of the drive transistor $TD_G$ is likely to be influenced by the fluctuation of the data signals $Vdat_R$ and $Vdat_B$.

The voltage $V_g$ of the gate node of the drive transistor $TD_G$ fluctuates under the influence of the data signals $Vdat_R$ and $Vdat_B$, whereby the light emission luminance of the light emitting element $EL_G$ fluctuates.

Similarly, voltages of gate nodes of the drive transistors $TD_R$ and $TD_B$ fluctuate under the influence of the data signal of the different luminescent color, whereby the light emission luminance of the light emitting elements $EL_R$ and $EL_B$ fluctuates.

On the contrary, parasitic capacitors CP3' and CP4' are located in the pixel circuit 20 of FIG. 8 between the gate node of the drive transistor TD and the data signal lines Vdat (m−1) and Vdat (m+1) of the adjacent different pixel circuits. Thus, a voltage $V_g'$ of the gate node of the drive transistor TD in the pixel circuit 20 is influenced by the fluctuation of the data signals Vdat (m−1) and Vdat (m+1) of the pixel circuits 20 in the adjacent columns via the parasitic capacitors CP3' and CP4'.

One data signal line Vdat is provided for each pixel circuit 20, and thus an interval between the data signal lines Vdat is wider than an interval between a combination of the data signal lines $Vdat_R$, $Vdat_G$, and $Vdat_B$ of the pixel circuit 70 of FIG. 10.

Capacitance values are inversely proportional to a distance between electrodes, thus reaching CP3'<CP3 and CP4'<CP4 through comparison with the pixel circuit 70. The parasitic capacitors CP3' and CP4' are respectively smaller than the parasitic capacitors CP3 and CP4, and thus the voltage $V_g'$ of the gate node of the drive transistor TD is hardly influenced by the data signal of the adjacent pixel circuit.

Moreover, the holding capacitor CS, the drive transistors TD, and the data signal lines Vdat are arranged in the different sub-pixel regions, thereby making it easy to upsize the holding capacitor CS. As a result of upsizing the holding capacitor CS, a total of the capacitors (including the parasitic capacitors) connected to the gate node increases, thus making it possible to more reduce the fluctuation of the voltage V of the gate node of the drive transistor TD attributable to the capacitive coupling.

Further, since light emission of the different luminescent colors are performed sequentially in a time-sharing manner in the pixel circuit 20, the data signal related to the luminance of the same luminescent color is transmitted at the same timing in the adjacent data signal line. As a result, color crosstalk such that the luminance of one of the luminescent colors is influenced by the luminance of another one of the luminescent colors is practically resolved.

Figure 11:
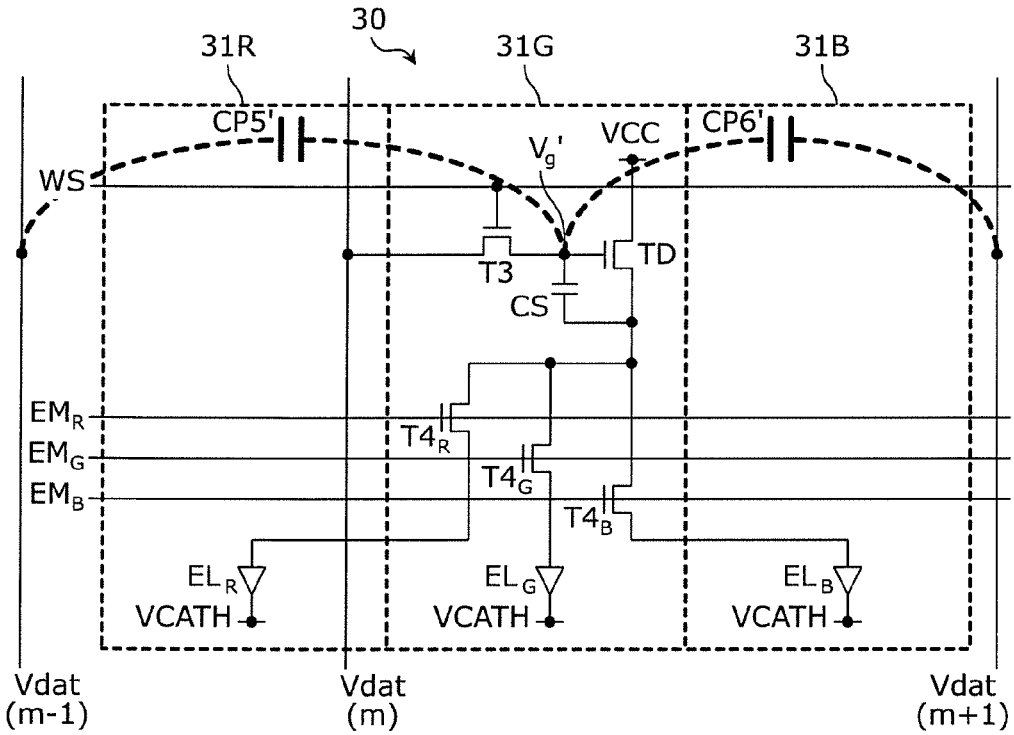
FIG. 11 is a circuit diagram illustrating one example of a configuration of a pixel circuit according to Modified Example 2.

FIG. 11 is a circuit diagram illustrating one example of a configuration of a pixel circuit 30 according to Modified Example 2. As illustrated in FIG. 11, the pixel circuit 30 is formed in a pixel region 30 divided into sub-pixel regions 31R, 31G and 31B respectively corresponding to luminescent colors R, G, and B.

The pixel circuit 30 has a write transistor T3, a holding capacitor CS, a drive transistor TD, color selection transistors $T4_R$, $T4_G$, and $T4_B$, and light emitting elements $EL_R$, $EL_G$, and $EL_B$. Each of the transistors is formed by an N-type channel transistor as one example.

The pixel circuit 30 also has a control signal line WS, color selection lines $EM_R$, $EM_G$, and $EM_B$, a data signal line Vdat, a positive power line VCC, and a negative power line VCATH.

Note that FIG. 11 illustrates, together with a data signal line Vdat (m) of the pixel circuit 30, data signal lines Vdat (m−1) and Vdat (m+1) of different pixel circuits adjacent to both sides of the pixel circuit 30.

The write transistor T3 turns into an ON state in accordance with a control signal WS and holds a voltage of the data signal Vdat at the holding capacitor CS.

The drive transistor TD outputs a current at a level corresponding to the voltage held at the holding capacitor CS.

The color selection transistors $T4_R$, $T4_G$, and $T4_B$ selectively turn into an ON state in accordance with control signals $EM_R$, $EM_G$, and $EM_B$, and supply the current outputted from the drive transistor TD to the light emitting element $EL_R$, $EL_G$, or $EL_B$. Consequently, the light emitting elements $EL_R$, $EL_G$, and $EL_B$ emit light with luminance represented by the data signal Vdat.

A method for driving the pixel circuit 30 configured as described above will be described.

Figure 12:
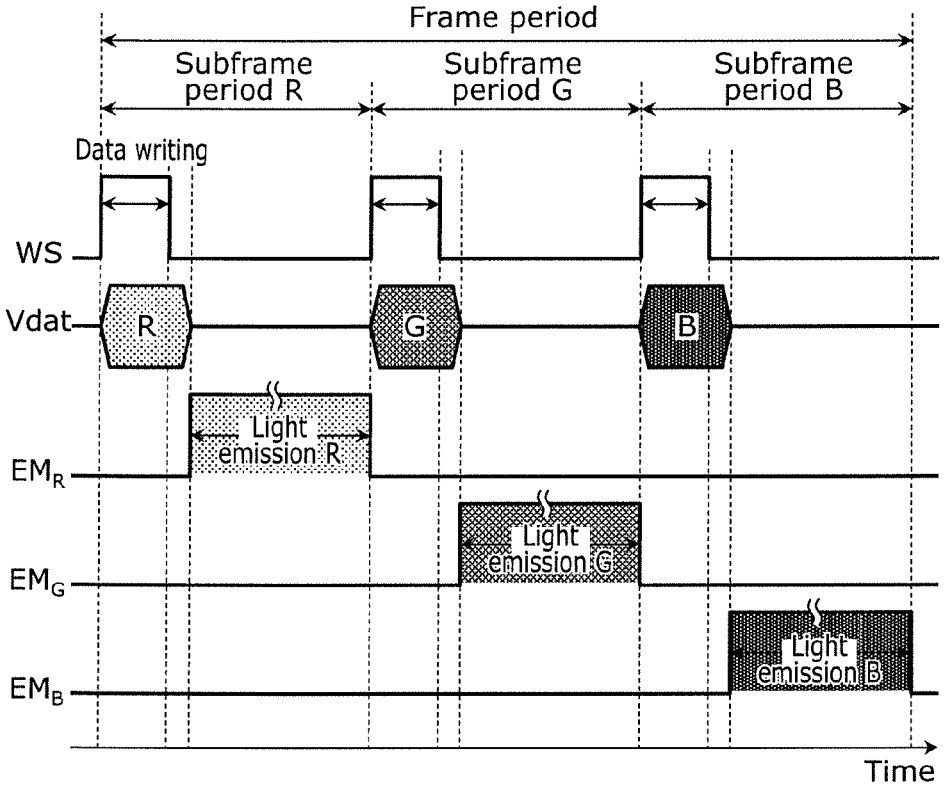
FIG. 12 is a timing chart illustrating one example of a method for driving the pixel circuit according to Modified Example 2.

FIG. 12 is a timing chart illustrating one example of the method for driving the pixel circuit 30. As illustrated in FIG. 12, the light emitting elements $EL_R$, $EL_G$, and $EL_B$ arranged in the sub-pixel regions 31R, 31G, and 31B in the pixel circuit 30 are caused to emit light sequentially in a time-sharing manner in subframe periods R, G, and B forming one frame period and corresponding to luminescent colors R, G, and B to thereby display a desired color through afterimage effect.

Specifically, the following operation is performed in the pixel circuit 30 in each of the subframe periods R, G, and B respectively corresponding to the luminescent colors R, G, and B in one frame period.

The data signal Vdat related to the light emission luminance of the luminescent color R, G, or B corresponding to the subframe period is held at the holding capacitor CS via the data signal line Vdat (data writing).

A current in accordance with the data signal Vdat held at the holding capacitor CS is outputted from the drive transistor TD. The current outputted from the drive transistor TD is supplied to the light emitting element $EL_R$, $EL_G$, or $EL_B$ for the luminescent color corresponding to the subframe period via any of the color selection transistors $T4_R$, $T4_G$, and $T4_B$ which are different for the respective subframe periods (light emission R, light emission G, and light emission B).

FIG. 12 illustrates the control signal for an N-type channel transistor although the control signal is not limited to this example. For example, the pixel circuit 30 may be formed by use of a P-type channel transistor, and used as a control signal in this case is a control signal for a P-type channel transistor obtained by inverting the polarities of the control signal illustrated in FIG. 12.

Reduction in color crosstalk occurring in the pixel circuit 30 configured as described above will be described based on comparison with a pixel circuit according to a comparative example.

Figure 13:
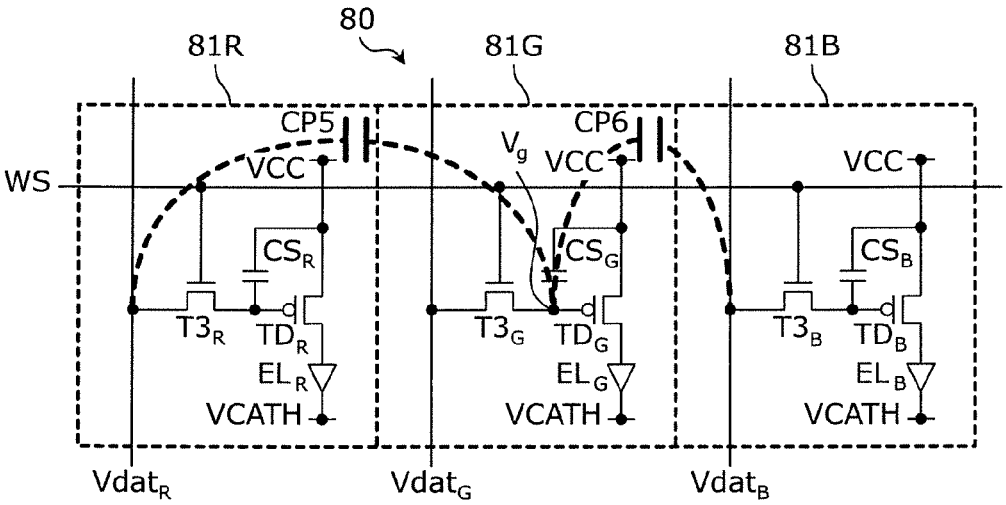
FIG. 13 is a circuit diagram illustrating one example of a configuration of a pixel circuit according to Comparative Example 2.

FIG. 13 is a circuit diagram illustrating one example of a configuration of a pixel circuit 80 according to Comparative Example 2. The pixel circuit 80 differs from the pixel circuit 30 in that data signal lines $Vdat_R$, $Vdat_c$, and $Vdat_B$ for respective luminescent colors, write transistors $T3_R$, $T3_G$, and $T3_B$, holding capacitors $CS_R$, $CS_G$, and $CS_B$, and drive transistors $TD_R$, $TD_G$, and $TD_B$ are provided in corresponding sub-pixel circuits 81R, 81G, and 81B and in that the drive transistors $TD_R$, $TD_G$, and $TD_B$ are formed by P-type channel transistors.

As illustrated in FIG. 13, parasitic capacitors CP5 and CP6 are located between a gate node of the drive transistor $TD_G$ and the data signal lines $Vdat_R$ and $Vdat_B$ of the sub-pixel circuits 81R and 81B. Thus, a voltage $V_g$ of the gate node of the drive transistor $TD_G$, that is, a data signal $Vdat_G$ held at the holding capacitor $CS_G$ is influenced by the fluctuation of the data signals $Vdat_R$ and $Vdat_B$ via the parasitic capacitors CP5 and CP6.

The data signal lines $Vdat_R$, $Vdat_G$, and $Vdat_B$ in the pixel circuit 80 are provided in the corresponding sub-pixel circuits 81R, 81G, and 81B adjacently to each other. Thus, the parasitic capacitors CP5 and CP6 are likely to increase and the voltage $V_g$ of the gate node of the drive transistor $TD_G$ is likely to be influenced by the fluctuation of the data signals $Vdat_R$ and $Vdat_B$.

The voltage $V_g$ of the gate node of the drive transistor $TD_G$ fluctuates under the influence of the data signals $Vdat_R$ and $Vdat_B$, whereby the light emission luminance of the light emitting element $EL_G$ fluctuates.

Similarly, voltages of gate nodes of the drive transistors $TD_R$ and $TD_B$ fluctuate under the influence of the data signal for the different luminescent color, whereby the light emission luminance of the light emitting elements $EL_R$ and $EL_B$ fluctuates.

On the contrary, parasitic capacitors CP5' and CP6' are located in the pixel circuit 30 of FIG. 11 between the gate node of the drive transistor TD and data signal lines Vdat (m−1) and Vdat (m+1) of adjacent different pixel circuits. Thus, the voltage $V_g'$ of the gate node of the drive transistor TD in the pixel circuit 30 is influenced by the fluctuation of data signals Vdat (m−1) and Vdat (m+1) of the pixel circuits 30 in the adjacent columns via the parasitic capacitors CP5' and CP6'.

Since one data signal line Vdat is provided for each pixel circuit 30, an interval between the data signal lines Vdat is wider than an interval between a combination of the data signal lines $Vdat_R$, $Vdat_G$, and $Vdat_B$ of the pixel circuit 80 of FIG. 13.

Capacitance values are inversely proportional to a distance between the electrodes, thus reaching CP5'<CP5 and CP6'<CP6 through comparison with the pixel circuit 80. The parasitic capacitors CP5' and CP6' are respectively smaller than the parasitic capacitors CP5 and CP6 and thus the voltage $V_g'$ of the gate node of the drive transistor TD is hardly influenced by the data signal of the adjacent pixel circuit.

Moreover, arranging the holding capacitor CS, the drive transistor TD, and the data signal line Vdat in the different sub-pixel regions makes it easy to upsize the holding capacitor CS. As a result of upsizing the holding capacitor CS, a total of the capacitors (including the parasitic capacitors) connected to the gate node increases, thus making it possible to more reduce the fluctuation of the voltage V of the gate node of the drive transistor TD attributable to capacitive coupling.

Further, since the light emission of the different luminescent colors are performed sequentially in a time-sharing manner in the pixel circuit 30, a data signal related to the luminance of the same luminescent color is transmitted at the same timing in the adjacent data signal line. As a result, color crosstalk such that the luminance of one of the luminescent colors is influenced by the luminance of another one of the luminescent colors is practically resolved.

The pixel circuit, the display device, and the methods for driving the pixel circuit according to the embodiment of the present disclosure have been described above, but the disclosure is not limited to the individual embodiment. Those obtained by making various modification, conceivable by those skilled in the art, to the embodiment and modes constructed by combining together the components in a different embodiment may also be included in a range of one or a plurality of modes of the present disclosure without departing from the spirits of the present disclosure.

For example, the gate drivers 13 and 14 may be arranged on the both sides of the display section 12. The gate drivers 13 and 14 may be formed by a shift register connecting a flip-flop circuit to a large number of stages. The gate drivers 13 and 14 may also be formed by any of a CMOS transistor, an N-type channel transistor, and a P-type channel transistor.

The display section 12 and the gate drivers 13 and 14 may be formed on a display panel. The data driver 15 may be formed on the display panel or may be formed on a flexible wiring film connecting together the display panel and the controller 16.

CONCLUSION

To address the object described above, a pixel circuit according to one aspect of the disclosure includes: one data signal line; one holding capacitor which holds a data signal transmitted through the one data signal line; one drive transistor which outputs a current in accordance with the data signal held at the one holding capacitor; three color selection lines; three color selection transistors having control terminals respectively connected to the three color selection lines that are mutually different; and three light emitting elements being connected to an output end of the current of the one drive transistor via the three color selection transistors, respectively, that are mutually different and emitting luminescent colors that are mutually different.

Consequently, data signals corresponding to the different luminescent colors can be supplied in a time-sharing manner by use of the one data signal line provided for each pixel circuit and the plurality of light emitting elements for the luminescent colors that are mutually different are caused to emit light sequentially in a time-sharing manner to thereby display a desired color through afterimage effect. An arrangement interval between the data signal lines widens from a conventional interval between the sub-pixel circuits to an interval between the pixel circuits, and thus the color crosstalk is reduced as a result of reducing the influence exerted between the data signals transmitted by the adjacent data signal lines.

Moreover, the pixel circuit may be formed in the pixel region including three sub-pixel regions and the three light emitting elements may be respectively arranged in the sub-pixel regions that are mutually different. The holding capacitor and the drive transistor may be arranged in one of the three sub-pixel regions and the data signal line may be arranged in any of the three sub-pixel regions other than the one sub-pixel region.

Consequently, it is easy to upsize the holding capacitor. The upsizing of the holding capacitor makes it possible to more suppress voltage fluctuation of the gate node of the drive transistor attributable to capacitive coupling to the data signal line of the adjacent pixel circuit.

Moreover, a method for driving a pixel circuit according to one aspect of the disclosure includes one data signal line, one holding capacitor, one drive transistor, three color selection transistors, and three light emitting elements. In the method, in each of three subframe periods forming one frame period and corresponding to luminescent colors that are mutually different, a data signal related to light emission luminance of the luminescent color corresponding to the subframe period is held at the holding capacitor via the one data signal line, a current in accordance with the data signal held at the holding capacitor is outputted from the drive transistor, and the current outputted from the drive transistor is supplied via any one of the three color selection transistors to the light emitting element that is included in the three light emitting elements and that emits the luminescent color corresponding to the subframe period.

Consequently, light emission of the different luminescent colors is performed sequentially in a time-sharing manner, and thus a data signal related to the light emission luminance of the same luminescent color is transmitted at the same timing in the data signal line of the adjacent pixel circuit. As a result, color crosstalk such that the luminance of one of the luminescent colors is influenced by the luminance of another one of the luminescent colors is practically resolved.

Moreover, a display device according to another aspect of the disclosure includes: a plurality of pixel circuits arranged in a matrix wherein a data signal line provided in is each of the plurality of pixel circuits arranged in each column of the matrix is connected together and color selection lines are provided for respective luminescent colors in each of the plurality of pixel circuits included in each row of the matrix and each of the color selection lines corresponding to the same luminescent color is connected together; a data driver connected to the data signal line in each column; and a gate driver connected to the color selection lines for the respective luminescent colors in each row.

Moreover, the display device may further include a timing controller, under control of which, in each of three subframe periods forming one frame period and corresponding to the luminescent colors that are mutually different, the data driver may supply, to the data signal lines in each column, a data signal related to light emission luminance of the luminescent color corresponding to the subframe period, and the gate driver may supply, sequentially row by row to the color selection line for the luminescent color corresponding to the subframe period in each row, a control signal for controlling the color selection transistor connected to the color selection line into a conductive state.

Consequently, a display device is provided which reduces color crosstalk based on the effect of the pixel circuit described above.

Although only an exemplary embodiment of the present disclosure has been described in detail above, those skilled in the art will readily appreciate that many modifications are possible in the exemplary embodiment without materially departing from the novel teachings and advantages of the present disclosure. Accordingly, all such modifications are intended to be included within the scope of the present disclosure.

INDUSTRIAL APPLICABILITY

The present disclosure is widely applicable as a pixel circuit, a display device, and a method for driving a pixel circuit to various video display devices such as a portable information terminal, a personal computer, a television receiver, etc.

The invention claimed is:

1. A pixel circuit, comprising:

one data signal line;

one holding capacitor which holds a data signal transmitted through the one data signal line;

one drive transistor which outputs a current in accordance with the data signal held at the one holding capacitor;

three color selection lines;

three color selection transistors having control terminals respectively connected to the three color selection lines, the three color selection transistors being mutually different; and three light emitting elements connected to an output end, which outputs the current, of the one drive transistor via the three color selection transistors, respectively, the three light emitting elements being mutually different and emitting luminescent colors that are mutually different, wherein the pixel circuit is arranged in a pixel region, the pixel region including three sub-pixel regions, the three sub-pixel regions being mutually different, the three light emitting elements are respectively arranged in the three sub-pixel regions, and the three color selection transistors are arranged in one of three sub-pixel regions in which the one drive transistor is arranged.

2. A display device, comprising:

a plurality of pixel circuits each being the pixel circuit according to claim 1, the plurality of pixel circuits being arranged in a matrix, wherein the one data signal line provided in each of the plurality of pixel circuits arranged in each column of the matrix is connected together, the three color selection lines provided for the luminescent colors in each of the plurality of pixel circuits arranged in each row of the matrix and corresponding to a same luminescent color are respectively connected together, and the display device further comprises:

a data driver connected to the one data signal line in each column; and a gate driver connected to the three color selection lines in each row.

3. The display device according to claim 2, further comprising:

a timing controller, wherein under control of the timing controller in each subframe period of three subframe periods, the three subframe periods forming one frame period and respectively corresponding to the luminescent colors that are mutually different:

the data driver supplies, to the one data signal line in each column, a data signal related to light emission luminance of one of the luminescent colors corresponding to the subframe period, and the gate driver supplies, sequentially row by row to one of the three color selection lines for the one of the luminescent colors corresponding to the subframe period in each row, a control signal for controlling, into a conductive state, one of the three color selection transistors connected to a corresponding one of the three color selection lines for the one of the luminescent colors corresponding to the subframe period in each row.

4. The pixel circuit according to claim 1, wherein the one holding capacitor is arranged in the one of the three sub-pixel regions, and the one data signal line is arranged in any of the three sub-pixel regions other than the one of the three sub-pixel regions.

5. The pixel circuit according to claim 1, further comprising:

one first reference voltage line; and a compensation transistor connected between the one first reference voltage line and a gate node of the one drive transistor, wherein the one first reference voltage line is arranged only in a second one of the three sub-pixel regions in which the one drive transistor is not arranged.

6. The pixel circuit according to claim 1, further comprising:

one second reference voltage line; and an initialization transistor connected between the one second reference voltage line and a source node of the one drive transistor, wherein the one second reference voltage line is arranged only in a second one of the three sub-pixel regions in which the one drive transistor is not arranged.

7. A method for driving a pixel circuit including one data signal line, one holding capacitor, one drive transistor, three color selection transistors, and three light emitting elements, the method comprising:

in each subframe period of three subframe periods, the three subframe periods forming one frame period and respectively corresponding to luminescent colors, the luminescent colors being mutually different:

holding a data signal at the one holding capacitor via the one data signal line, the data signal being related to light emission luminance of one of the luminescent colors corresponding to the subframe period;

outputting, from the one drive transistor, a current in accordance with the data signal held at the one holding capacitor; and supplying, via one of the three color selection transistors, the current outputted from the one drive transistor to a corresponding one of the three light emitting elements that emits the one of the luminescent colors corresponding to the subframe period, wherein the pixel circuit is arranged in a pixel region, the pixel region including three sub-pixel regions, the three sub-pixel regions being mutually different, the three light emitting elements are respectively arranged in the three sub-pixel regions, and the three color selection transistors are arranged in one of three sub-pixel regions in which the one drive transistor is arranged.

8. The method according to claim 7, wherein the pixel circuit further includes:

one first reference voltage line; and a compensation transistor connected between the one first reference voltage line and a gate node of the one drive transistor, and the one first reference voltage line is arranged only in a second one of the three sub-pixel regions in which the one drive transistor is not arranged.

9. The method according to claim 7, wherein the pixel circuit further includes:

one second reference voltage line; and an initialization transistor connected between the one second reference voltage line and a source node of the one drive transistor, and the one second reference voltage line is arranged only in a second one of the three sub-pixel regions in which the one drive transistor is not arranged.

* * * * *